US006416359B1

(12) United States Patent
Zhang et al.

(10) Patent No.: US 6,416,359 B1
(45) Date of Patent: Jul. 9, 2002

(54) ELECTRICAL CONNECTOR

(75) Inventors: Guo Zeng Zhang; Zhiqiang Wang; GuangXing Shi, all of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/877,556

(22) Filed: Jun. 8, 2001

(30) Foreign Application Priority Data

Apr. 27, 2001 (TW) ..... 90206780 U

(51) Int. Cl.[7] ..... H01R 13/648
(52) U.S. Cl. ..... 439/607
(58) Field of Search ..... 439/607–610, 439/571, 572, 567

(56) References Cited

U.S. PATENT DOCUMENTS 5,725,386 A * 3/1998 Davis et al. ..... 439/607
5,938,473 A * 8/1999 Nishio et al. ..... 439/607
6,132,254 A * 10/2000 Wu ..... 439/607
6,135,790 A * 10/2000 Huang et al. ..... 439/607
6,186,830 B1 * 2/2001 Lin et al. ..... 439/607

* cited by examiner

*Primary Examiner*—Gary F. Paumen
(74) *Attorney, Agent, or Firm*—Wei Te Chung

(57) ABSTRACT

An electrical connector comprises an insulative housing (1) defining a number of passageways (14) therein, a number of terminals (3) received in the passageways (14), and a shielding shell (2) enclosing around the insulative housing (1). The insulative housing (1) having a base section (11) and a mating section (12) extending forward from the base section (11). The shielding shell (2) comprises a mating frame (21) covering the mating section (12) of the insulative housing (1) and an extension (215) extending from the mating frame (21). The extension (215) includes a supporting leg (2152) integrally connecting with the mating frame (21) and a board lock (2151) integrally extending from the supporting leg (2152),the supporting leg (2152) has a larger width than that of the board lock (2151).

1 Claim, 7 Drawing Sheets

ELECTRICAL CONNECTOR

BACKGROUND OF THE INVENTION

1. Field of the Invention

The present invention relates to an electrical connector, and particularly to a Universal Serial Bus (USB) connector stably mounted onto a printed circuit board.

2. Description of the Related Art

A Universal Serial Bus (USB) connector is commonly used in computer systems and networks. FIG. 7 shows a conventional USB connector which comprises an insulative housing 5, a plurality of terminals 6 received in the insulative housing 5, and a first and second shielding shells 7,8 enclosing around the insulative housing 5. The insulative housing 5 comprises a base section 51 and a mating section 52 perpendicularly extending forward from the base section 51. The base section 51 has a pair of supporting portions 511 extending downward from a bottom thereof. The first shell 7 is formed by stamping a single piece of metal sheet and has two side panels 71 and a mating frame 70 covering the mating section 52 of the insulative housing 5. The mating frame 70 defines a board lock 711 and a supporting leg 712 respectively extending from a bottom panel 72 thereof. The second shell 8 has a pair of board locks 83 respectively extending downwardly from two sidewalls thereof. When the USB connector is mounted onto a printed circuit board (not shown), the supporting leg 712 of the first shell 7 and the supporting portions 511 of the insulative housing 5 both abut against the printed circuit board so as to support the connector on the printed circuit board. The board locks 711,83 are solderably received within corresponding holes of the circuit board, whereby the connector is fixed on the printed circuit board.

However, the board lock 711 and the supporting leg 712 are respectively formed by folding with a narrow connecting portion 713 therebetween, so the mechanical strength of the connecting portion 713 is weak. When a mating connector is inserted into or pulled out from the connector, inappropriate inserting and pulling force will cause deformation of the connecting portion 713, even breaking the connecting portion 713. This will cause the mating frame 70 to decline and thus will cause an unreliable engagement between the USB connector and the mating connector as well as affect the quality of signal transmission therebetween. Furthermore, the board lock 711 and the supporting leg 712 are separately made and the width of the supporting leg 712 is narrow, so the supporting portion 712 is easily broken during manufacturing operation, thus increasing the cost of manufacturing the connector.

Hence, an improved electrical connector is desired to overcome the disadvantages of the related art.

SUMMARY OF THE INVENTION

An object of the present invention is to provide an electrical connector which can be securely retained on a printed circuit board, thereby ensuring a reliable engagement between the electrical connector and a mating connector.

Another object of the present invention is to provide an electrical connector whose supporting leg is easy to make, and the supporting leg has a firm connection with a shell.

To achieve the above-mentioned objects, an electrical connector in accordance with the present invention comprises an insulative housing, a plurality of terminals, and a shielding shell enclosing around the insulative housing. The insulative housing comprises a base section, a mating section extending from the base section, a plurality of passageways extending through the mating section and the base section, a pair of supporting portions extending downwardly from a bottom wall of the base section. The terminals are received in the passageways of the insulative housing. Each terminal has a mating portion for electrically engaging with a mating connector and a tail portion extending out of the bottom wall of the base section for electrically connecting with a printed circuit board. A shielding shell includes a mating frame covering the mating section of the housing. The mating frame defines a T-shaped extension at a bottom panel thereof. The extension includes a supporting leg integrally connecting with the mating frame and a board lock integrally extending from the supporting portion. When the electrical connector is mounted onto the printed circuit board, the supporting portions of the insulative housing and the supporting leg of the extension both snugly abut against the circuit board for supporting the electrical connector, thereby the electrical connector is securely mounted on the printed circuit board.

Other objects, advantages and novel features of the invention will become more apparent from the following detailed description of the present embodiment when taken in conjunction with the accompanying drawings.

DETAILED DESCRIPTION OF THE INVENTION

Figure 1:
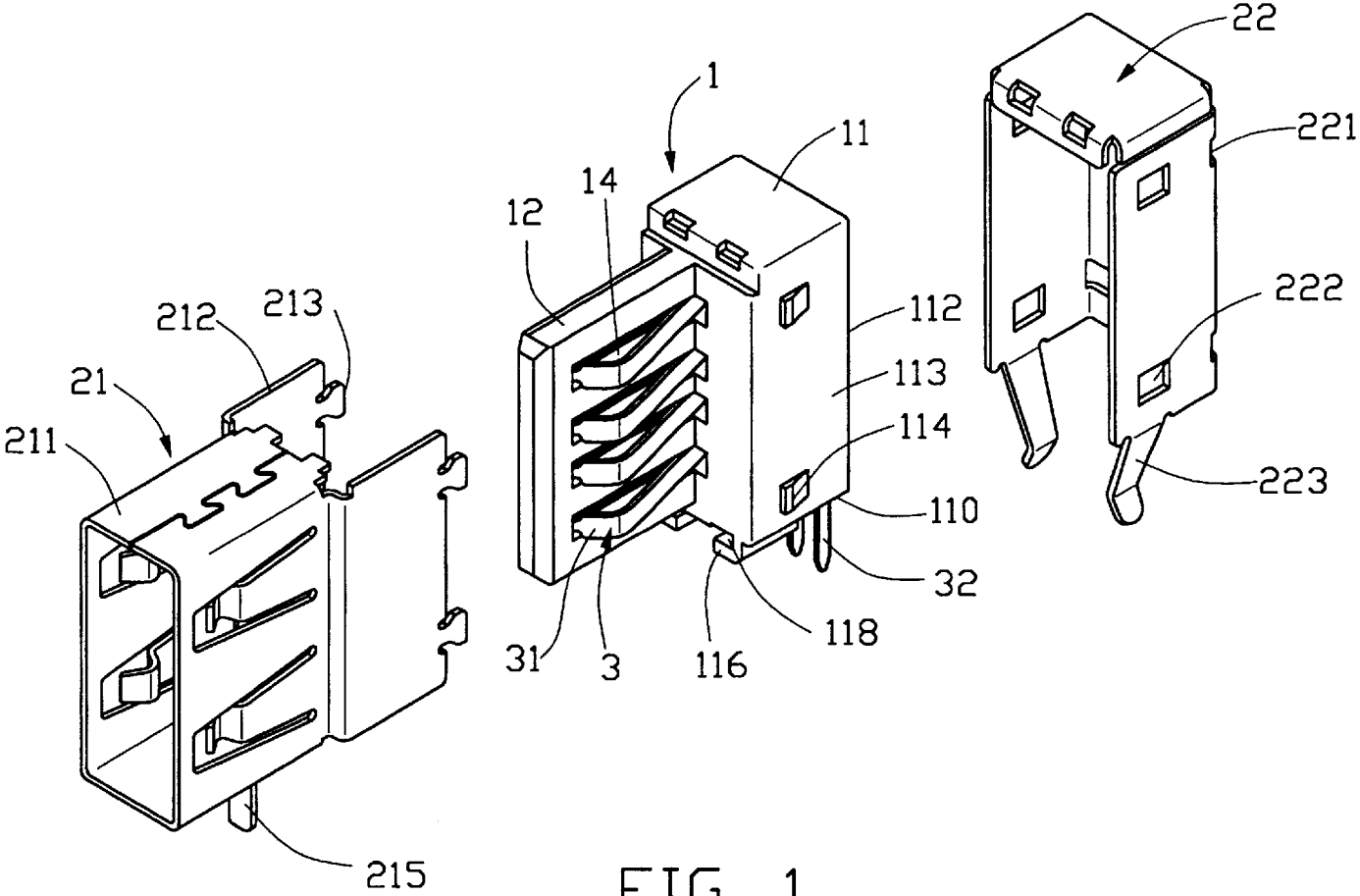
FIG. 1 is an exploded perspective view of an electrical connector in accordance with the present invention.

Referring to FIG. 1, an electrical connector in accordance with the present invention comprises an insulative housing 1, a shielding shell 2 (FIG. 3) enclosing around the insulative housing 1, and a plurality of terminals 3 received in the insulative housing 1.

Figure 5:
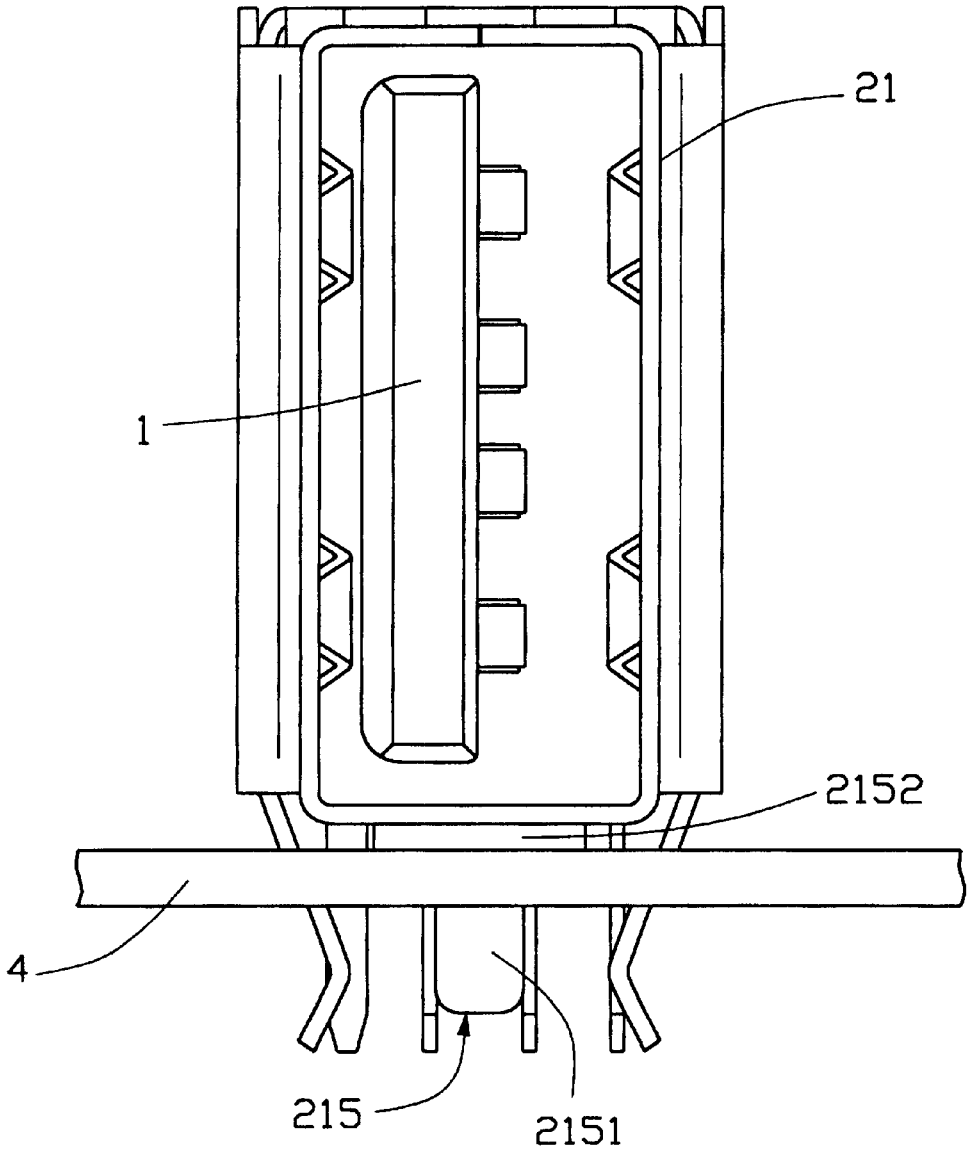
FIG. 5 is a front view of the electrical connector connecting with a printed circuit board.
Figure 6:
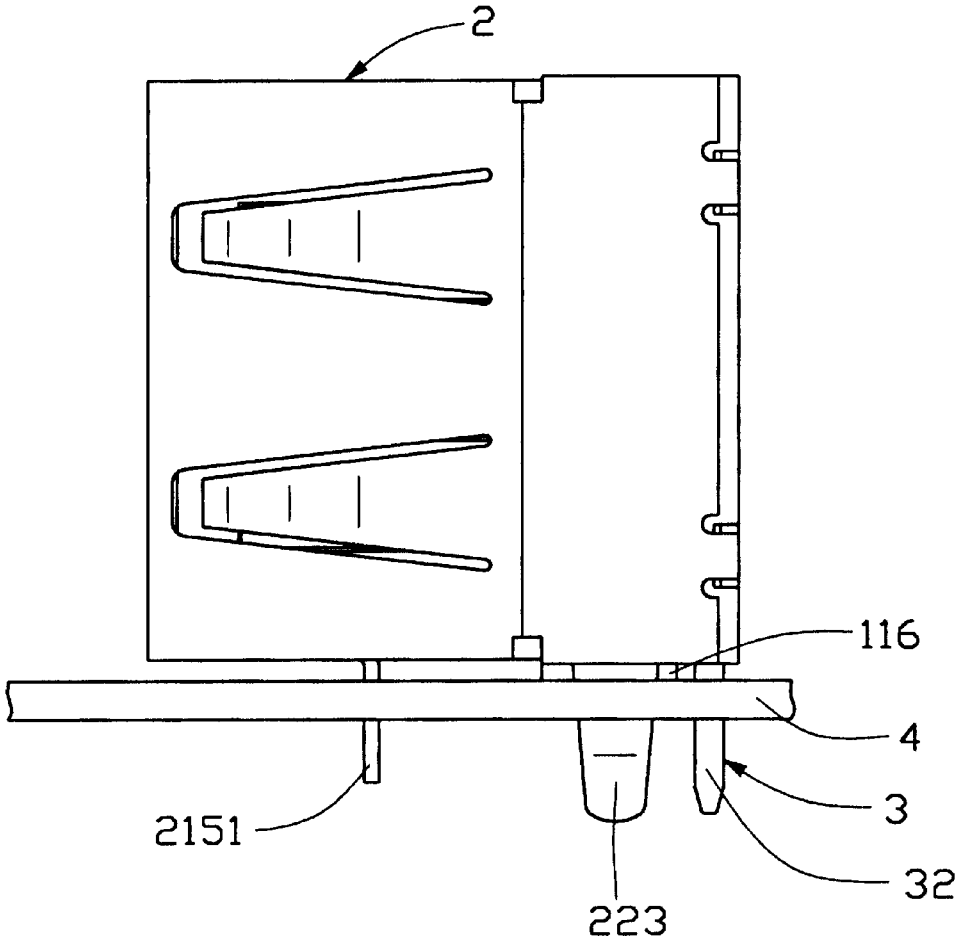
FIG. 6 is a side view of the electrical connector connecting with the printed circuit board.
Figure 7:
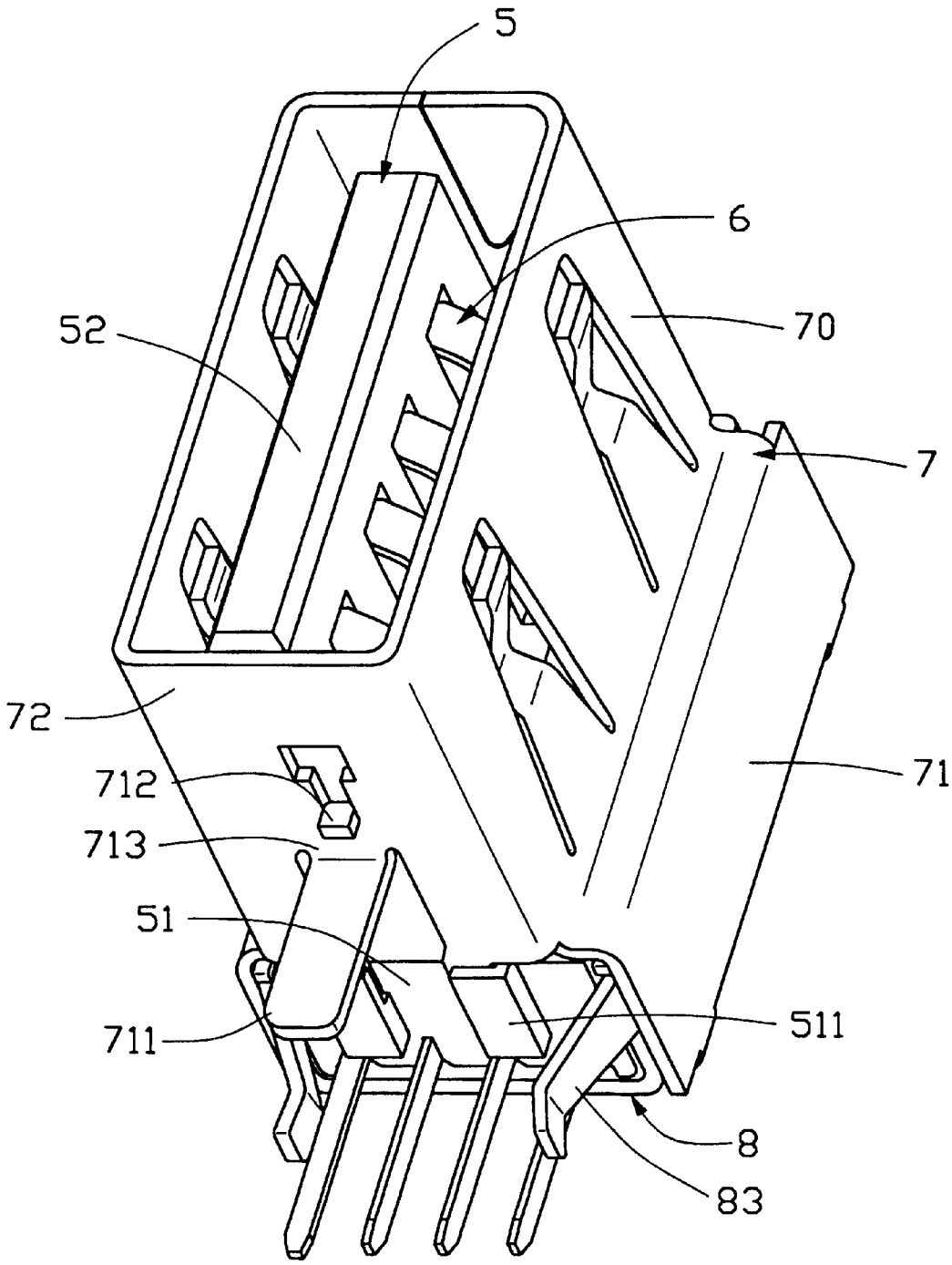
FIG. 7 (PRIOR ART)
FIG. 7 is an assembled perspective view of a conventional electrical connector.

The insulative housing 1 includes a base section 11 of a rectangular configuration, and a mating section 12 perpendicularly extending forward from the base section 11. The base section 11 comprises a bottom wall 110 facing a printed circuit board 4 (FIG. 5), a rear wall 112, and two sidewalls 113 having a plurality of protrusions 114 thereon. The bottom wall 10 defines a pair of supporting portions 116 extending downwardly therefrom. Moreover, the supporting portions 116 forms a guiding recess 118. The mating section 12 defines a plurality of passageways 14 extending through the base section 11 for receiving the terminals 3.

Each terminal 3 comprises a mating portion 31 for electrically engaging with a mating connector (not shown), a securing portion (not labeled) embedded in the base section 11 of the housing 1, and a tail portion 32 extending from the securing portion beyond the bottom wall 110 of the base section 11 for electrically connecting with the printed circuit board 4.

Figure 2:
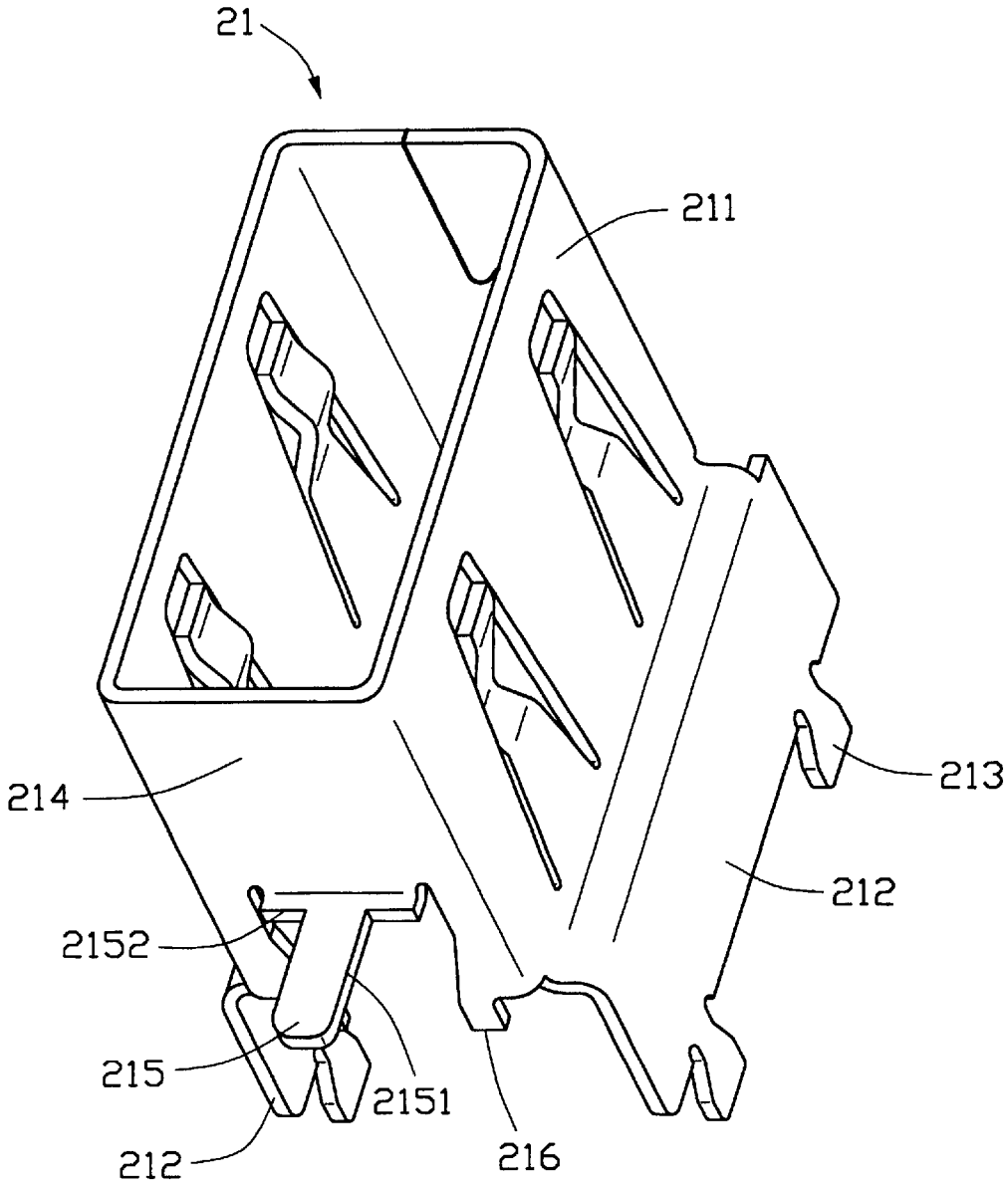
FIG. 2 is a perspective view of a first shell of the electrical connector.

Referring to FIGS. 1 and 2, the shielding shell 2 comprises a first shell 21 and a second shell 22. The first shell 21 is formed by stamping a single piece of metal sheet. The first shell 21 comprises a mating frame 211 and two side panels 212 integrally extending from the mating frame 211. The two side panels 212 respectively define a plurality of projections 213. A bottom panel 214 of the mating frame 211 defines a T-shaped extension 215 folding down therefrom and a pair of guiding portions 216 extending rearward therefrom for being inserted into the guiding recess 118 of the housing 1. The T-shaped extension 215 includes a supporting leg 2152 integrally connecting with the bottom panel 214 of the mating frame 211 and a board lock 2151 integrally extending from the supporting portion 2152 for being solderably received within a corresponding hole (not labeled) of the printed circuit board 4. The second shell 22 defines a plurality of cutouts 221 on a rear wall thereof for receiving and retaining the projections 213 of the first shell 21, a plurality of fixed holes 222 on two opposite side walls thereof for receiving the protrusions 114 of the insulative housing 1, and a pair of board locks 223 extending downwardly from the two side walls for being solderably received within corresponding holes of the printed circuit board 4.

Figure 3:
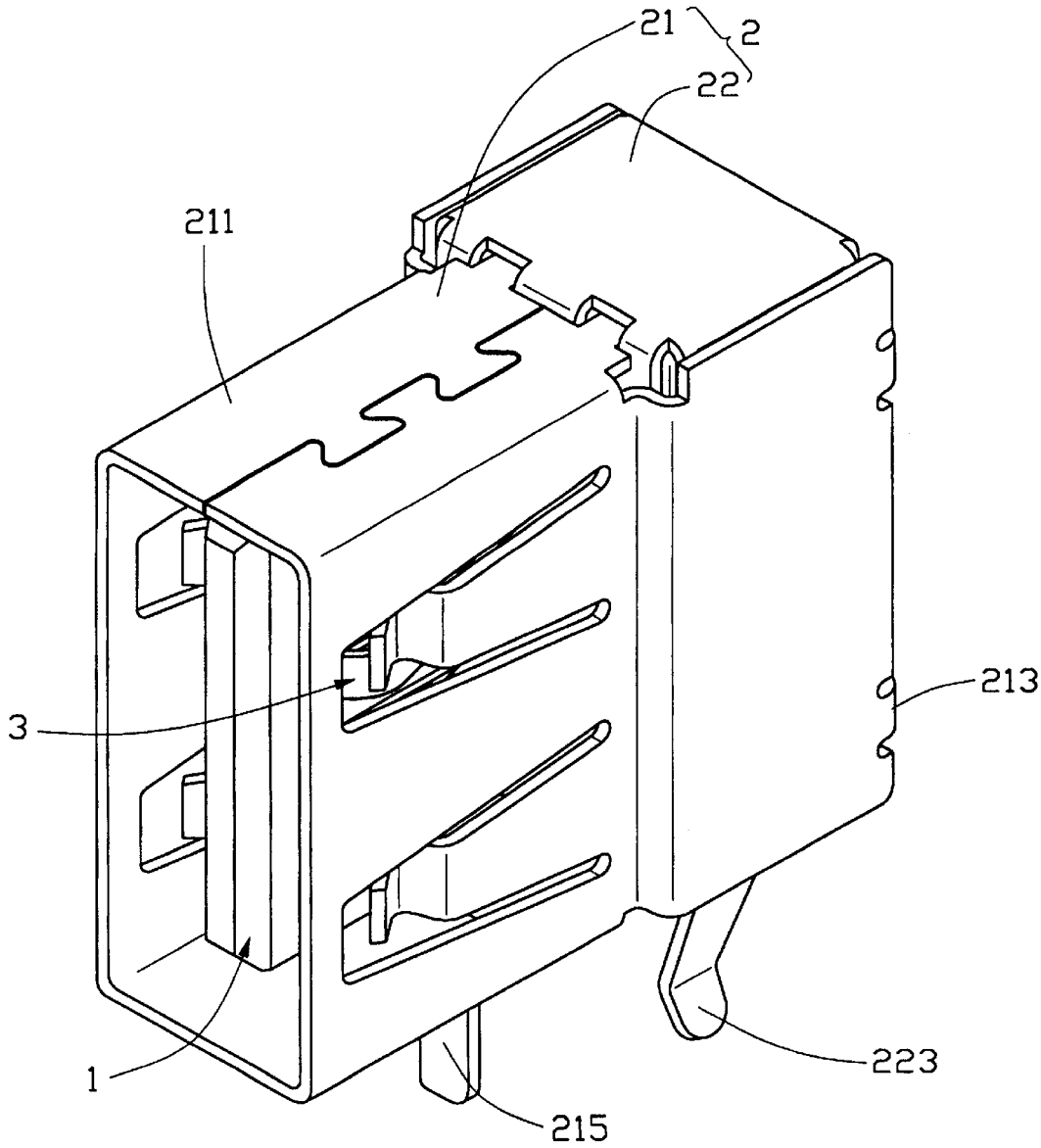
FIG. 3 is an assembled perspective view of FIG. 1.
Figure 4:
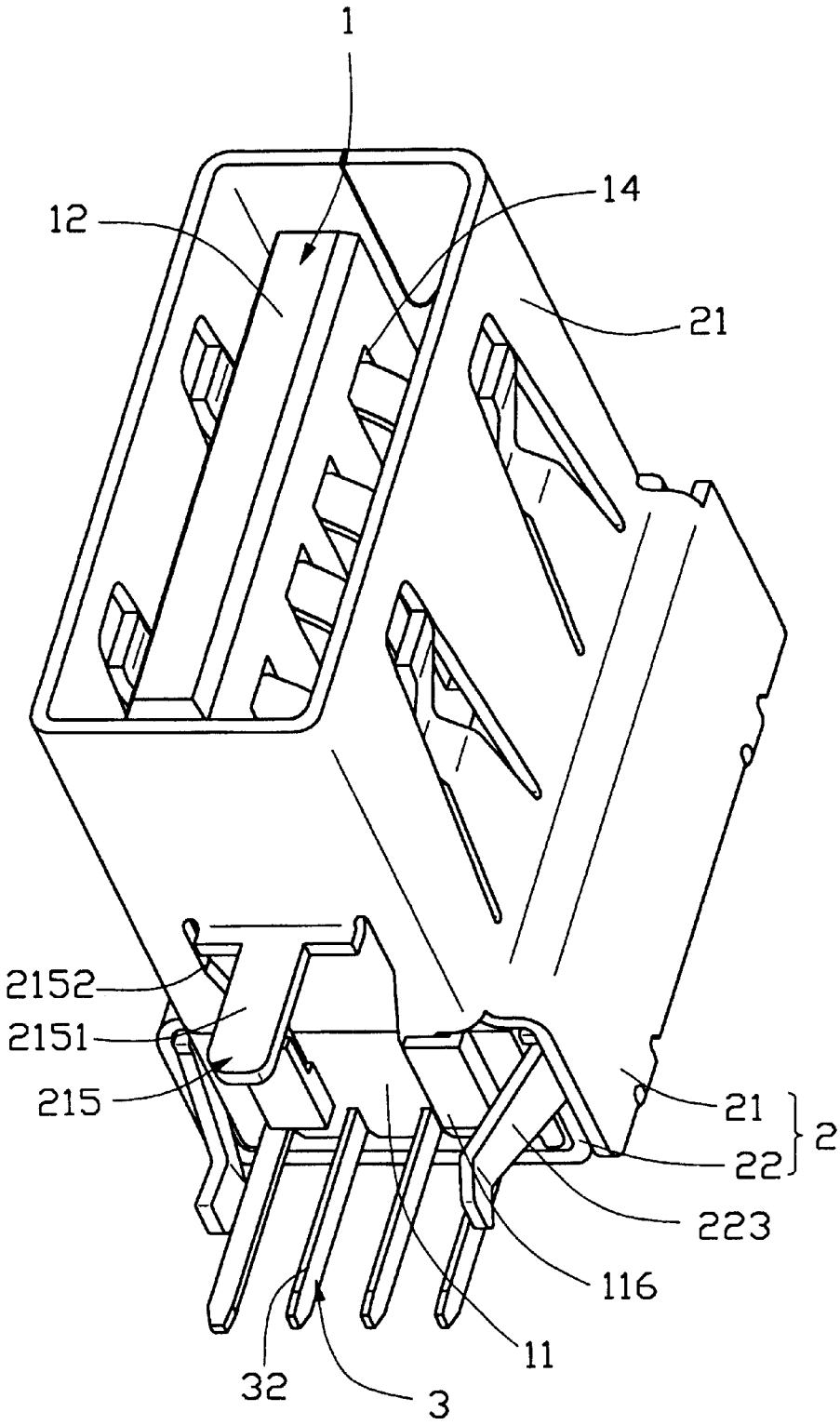
FIG. 4 is a view similar to FIG. 3 but taken from a different perspective.

Referring to FIGS. 1, 3 and 4, in assembly, the base section 11 of the insulative housing 1 is inserted into the second shell 22 until the protrusions 114 of the housing 1 are respectively received and retained in the corresponding fixed holes 222 of the second shell 22. Then, the insulative housing 1 covering the second shell 22 is inserted into the first shell 21 until the guiding portion 216 of the first shell 21 is received in the guiding recess 118 of the housing 1 and the projections 213 of the first shell 21 are respectively received and retained in the cutouts 221 of the second shell 22. Thus, the insulative housing 1 is firmly covered with the first shell 21 and the second shell 22.

When the electrical connector is mounted on the printed circuit board 4, the tail portion 32 of each terminal 3 is received within a corresponding hole of the printed circuit board 4 for electrically connecting with the circuit board 4. The board locks 2151,223 are respectively received within corresponding holes of the circuit board 4. Also, the supporting portions 116 of the housing 1 and the supporting leg 2152 of the extension 215 of the first shell 21 both snugly abut against the circuit board 4 for supporting the electrical connector, thereby securely mounting the electrical connector on the circuit board 4. Furthermore, the T-shaped extension 215 is integrally connected with the mating frame 211 of the first shell 21 and a connecting portion therebetween has a larger width, thereby ensuring a high mechanical strength of the supporting leg 2152 of the extension 215 and further ensuring a reliable engagement between the electrical connector and the mating connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for being mounted onto a printed circuit board, comprising:

an insulative housing comprising a base section, a mating section extending from the base section, a plurality of passageways extending through the mating section and the base section, and a pair of supporting portions extending downwardly from a bottom wall of the base section;

a plurality of terminals received in the passageways of the insulative housing, each terminal comprising a mating portion for electrically engaging with a mating connector and a tail portion for being electrically connected with the printed circuit board; and a metal shielding shell enclosing the insulative housing and comprising a mating frame, the mating frame covering the mating section of the insulative housing and defining an extension at a bottom panel thereof, the extension including a supporting leg integrally connecting with the mating frame and a board lock integrally extending from the supporting leg, the supporting leg having a larger width than that of the board lock;

wherein the extension is folded down from the bottom panel of the mating frame and is of a T-shaped configuration;

wherein the supporting portions of the insulative housing and the supporting leg of the extension both abut against the printed circuit board;

wherein the shielding shell comprises a first shell defining the mating frame and the extension and a second shell covering the base section of the insulative housing;

wherein the insulative housing defines a plurality of protrusions, and the second shell defines a plurality of fixing holes for receiving the protrusions;

wherein the second shell defines a pair of board locks for being solderably received within corresponding holes of the printed circuit board;

wherein a guiding recess is formed between the supporting portions of the insulative housing, and the bottom panel of the mating frame has a pair of guiding portions received in the guiding recess;

wherein a pair of side panels of the first shell respectively define a plurality of projections extending rearwardly therefrom, and the second shell defines a plurality of cutouts for receiving the projections.

* * * * *